United States Patent [19]

Smith, Sr.

[11] 4,263,013

[45] Apr. 21, 1981

[54] COAL CLEANING

[75] Inventor: George A. Smith, Sr., Philadelphia, Pa.

[73] Assignee: Fluid Coal Corporation, Wilmington, Del.

[21] Appl. No.: 65,290

[22] Filed: Aug. 9, 1979

[51] Int. Cl.[3] ..... C10L 9/00

[52] U.S. Cl. ..... 44/1 B

[58] Field of Search ..... 44/1 R, 1 B; 208/8 LE

[56] References Cited

U.S. PATENT DOCUMENTS

| | | | |
|---|---|---|---|
| 1,925,005 | 8/1933 | Rose et al. | 44/1 B |
| 2,670,317 | 2/1954 | Adams | 208/8 LE |
| 3,252,769 | 5/1966 | Nagelvoort | 44/1 R |
| 3,642,608 | 2/1972 | Roach et al. | 208/8 |
| 3,932,145 | 1/1976 | Foulke | 44/1 R |
| 4,159,897 | 7/1979 | Doehlert | 44/51 |

*Primary Examiner*—Carl F. Dees

*Attorney, Agent, or Firm*—Howson and Howson

[57] ABSTRACT

In a coal cleaning process in which oil is used as a cleaning medium, oil remaining in the solid refuse of the cleaning process is recovered for reuse by multi-stage treatment using a volatile solvent such as liquefied petroleum gas. The oil and solvent are separated by evaporation and the gaseous solvent is liquefied for reuse. A similar process is usable for removing oil from coal to produce a dry coal.

11 Claims, 1 Drawing Figure

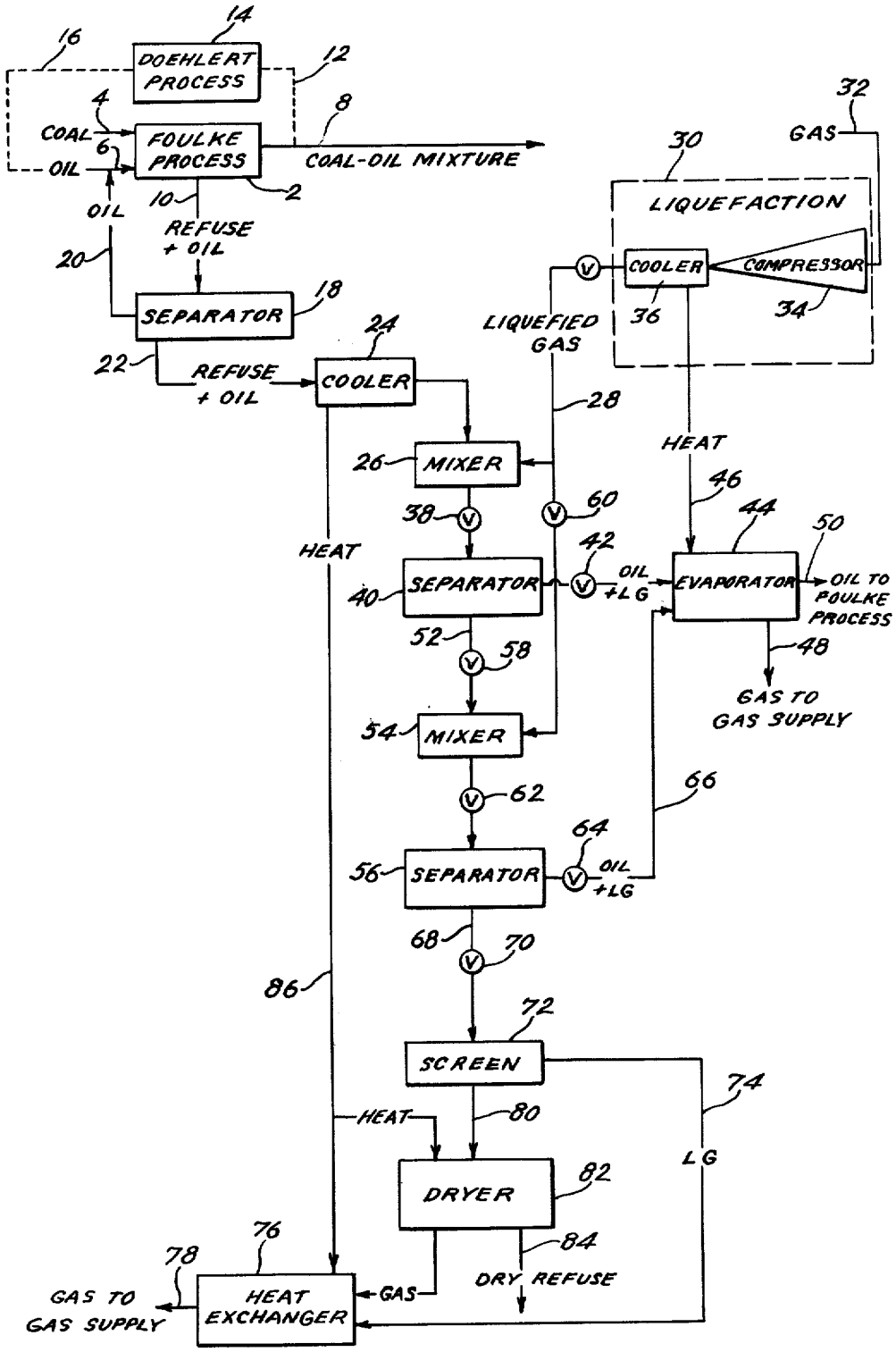
DOEHLERT PROCESS
FOULKE PROCESS
COAL
OIL
OIL
COAL-OIL MIXTURE
REFUSE + OIL
SEPARATOR
REFUSE + OIL
COOLER
MIXER
SEPARATOR
OIL +LG
MIXER
SEPARATOR
OIL +LG
SCREEN
DRYER
DRY REFUSE
HEAT EXCHANGER
GAS
GAS TO GAS SUPPLY
HEAT
HEAT
LG
LIQUEFACTION
COOLER
COMPRESSOR
GAS
LIQUEFIED GAS
HEAT
EVAPORATOR
OIL TO FOULKE PROCESS
GAS TO GAS SUPPLY

COAL CLEANING

BRIEF SUMMARY OF THE INVENTION

This invention relates to the cleaning of coal and particularly to improvements in processes for cleaning coal in which oil is used as a cleaning medium.

U.S. Pat. No. 3,932,145 of Willing B. Foulke, dated Jan. 13, 1976, describes a process of producing a coal-oil fuel in which coal is cleaned using oil as a cleaning medium. The process described in the Foulke patent is usable with various forms of coal including bituminous, anthracite, lignite and others. In the Foulke process a low-sulfur fuel consisting essentially of coal particles suspended in an oil is produced by the steps of introducing a mixture of coal particles and undesired particles having higher specific gravity than coal into a concentrator, introducing oil into the concentrator, cleaning the mixture in the concentrator using oil as the cleaning medium by effecting settling of undesired particles, and removing from the concentrator a suspension of coal particles in oil for use as a fuel. The concentrator of the Foulke process can be any one of a wide variety of concentrators of the type conventionally used for the beneficiation of coal using water as the cleaning medium. Suitable concentrators include, for example, hindered settling concentrators such as the Fahrenwald classifier, the Spitzkasten classifier, the Rheolaveur, the Chance cone, and various forms of jigs, and sliding friction concentrators such as Wilfley tables, Deister tables, and Vanners. In the Foulke process, the concentrator serves to separate a usable coal-oil mixture from refuse consisting primarily of pyrites and gypsum. The refuse, of course, may also contain various other substances such as shale, bone, calcite, clay, slate and marcasite.

The refuse taken from the concentrator, carries with it a considerable quantity of oil. The refuse, including oil is passed through a thickener, and the thickened refuse is then passed over a Deister table for further separation. Some oil and coal from the Deister table is of sufficiently high quality to be returned to the concentrator. Heavy refuse from the concentrator is treated by a first basket centrifuge for the further separation of oil. The oil from the first basket centrifuge is returned to the concentrator, and the heavy refuse is discarded. Lighter refuse from the table is delivered to a second basket centrifuge. Oil from this second centrifuge is returned to the concentrator, and the refuse from the second centrifuge, which contains some oil, is burned for process heat. The combustion products of the burning step require stack gas treatment.

While basket centrifuges are given as examples of separators in the Foulke patent, of course various other forms of separators may be used alternatively, including, for example, cyclone separators. While the basket centrifuges or other separators used in the Foulke process are capable of returning considerable oil to the concentrator, the refuse from these separators nevertheless necessarily carries with it quantities of oil which might be better used if returned to the concentrator rather than discarded or burned along with refuse to produce process heat.

The object of this invention is to provide a new and more effective way of treating refuse in the Foulke process and in other processes in which oil is used as a cleaning medium for coal. It is also an object of the invention to provide oil suitable for use for various purposes such as burning in relatively clean form for the production of heat without the need for stack gas treatment, and for reuse as a cleaning medium.

In accordance with this invention, the refuse produced in the cleaning of coal using oil as a cleaning medium is admixed with a volatile solvent. The solvent dissolves at least a portion of the refuse-carried oil. The admixture is then mechanically separated into a first component comprising a mixture of oil and solvent and a second component comprising solid refuse and solvent. A substantial portion of the refuse-carried oil is washed out of the refuse by the solvent and is carried away in the first component. Therefore, the proportion of oil to refuse in the second component is less than the proportion of oil to refuse in the refuse produced in the cleaning process. Solvent is evaporated from one or both of the first and second components and is recovered. After evaporation of solvent from the first component, what remains is essentially refuse-free oil which can be burned or returned to the cleaning process. After evaporation of solvent from the second component, what remains is essentially dry, substantially oil-free refuse, which can be discarded.

The process in accordance with the invention is usable as a modification to the specific process described by Foulke, and is more broadly useful in any process for cleaning coal in which oil is used as a cleaning medium and in which solid refuse is produced which carries with it a quantity of oil.

A related process may be used in the treatment of coal-oil mixtures for the recovery of oil therefrom.

Various other objects and advantages of the invention will be more apparent from the following detailed description when read in conjunction with the drawing.

BRIEF DESCRIPTION OF THE DRAWING

The single FIGURE is a schematic diagram illustrating the apparatus used to carry out the process of the invention, and showing various components of the apparatus, their interconnections, and their heat-exchange relationships.

DETAILED DESCRIPTION

Foulke process apparatus 2 comprises as its essential element a concentrator for effecting cleaning of coal using oil as a cleaning medium. The Foulke process apparatus may also include various auxiliary pieces of equipment such as are described in Foulke U.S. Pat. No. 3,932,145. These auxiliary pieces of equipment include, for example, apparatus for heating oil prior to its introduction into the concentrator, and apparatus for grinding coal in the presence of oil prior to introduction of the coal into the concentrator. The Foulke apparatus may also include various refuse treatment stages for the partial removal of oil from solid refuse. For a more detailed description of the Foulke process, reference should be made to Foulke U.S. Pat. No. 3,932,145, the entire disclosure of which is incorporated herein by reference.

Coal is introduced into the Foulke apparatus through path 4, and oil is introduced through path 6. The oil in path 6 can be any one of a wide variety of petroleum oils including the various grades of standard fuel oils ranging from No. 1 (Kerosene) to No. 6 (Bunker C). Heated neutralized acid sludge can also be used, as can various other petroleum oils such as diesel fuel and jet fuel. Other oils not derived from petroleum, such as vegetable oils, animal oils and synthetic oils (Synfuel) derived from coal may also be used.

The Foulke process delivers, through path 8, a coal-oil mixture suitable for use as a fuel. The Foulke process also produces refuse in path 10. This refuse necessarily contains some oil, since it is not possible to effect complete separation of refuse and oil by mechanical means such as decanters, screens, centrifuges and the like.

The oil delivered to the Foulke apparatus through path 6 can be derived from the coal-oil mixture in path 8 by the use of the process described in U.S. Pat. No. 4,159,897 of David H. Doehlert, dated July 3, 1979. The Doehlert process uses coal liquefaction to convert the coal component of the coal-oil mixture to oil, and the optional use of the Doehlert process is indicated in the drawing by the loop consisting of path 12, Doehlert process apparatus 14 and path 16. The entire disclosure of the Doehlert patent is also incorporated herein by reference.

The refuse and oil in path 10 is delivered to a separator 18. Various forms of mechanical separators can be used. For example, separator 18 can be a thickener, a decanter, a screen, a sieve, a cyclone separator, or a basket centrifuge, or a combination of a table and one or more centrifuges similar to those described in the Foulke patent. Oil is returned from separator 18 through path 20 to oil inlet path 6 of the Foulke apparatus.

Refuse is delivered from separator 18 through path 22 to a cooler 24. The refuse in path 22 carries with it remaining oil which is not removed from the refuse by separator 18. In a large plant, considerable quantities of oil are present in path 22 depending on the affinity of the refuse for oil.

The refuse and oil are delivered from cooler 24 to a mixer 26, in which the refuse and oil are mechanically combined with a volatile solvent delivered to the mixer through path 28. The term "volatile solvent", as used herein means any solvent which is partially or completely miscible with the particular oil being used in the cleaning process, and which has a boiling point such that it can be substantially completely separated from the oil by evaporation, leaving the major portion or substantially all of the oil in liquid form. The choice of a preferred solvent depends to some extent on the particular oil being used. However, the choice of a solvent is not critical, and can be readily made by those skilled in petroleum engineering.

One particularly desirable form of solvent is liquefied petroleum gas (LPG), which consists primarily of propane or butanes or mixtures thereof and has a boiling point ranging from −43° C. to +31° C. depending on the particular hydrocarbons involved. Liquefied petroleum gas is usable as a volatile solvent for any of the various petroleum oils and synthetic oils mentioned above, including the various standard fuel oils, diesel fuel, jet fuel, neutralized acid sludge and coal-derived synfuels. For reasons which will become apparent, the gas is preferably liquefied on site by means of a liquefaction apparatus 30. The liquefaction apparatus is conventional. It receives gas from path 32, and effects liquefaction by means of a compressor 34 and a cooler 36. The term "liquefaction", as used herein, of course should be understood as encompassing mere condensation, since compression may not be required for the conversion of higher-boiling volatile solvents to liquid form.

Cooler 24 reduces the temperature of the refuse and oil to a sufficiently low level as not to cause immediate evaporation of the liquefied gas when it comes into contact with the refuse and oil in mixer 26. The requirements of cooler 24 depend upon the characteristics of the particular liquefied gases used in the process. If, for example, isobutane is the principal component of the liquefied gas, cooler 24 should be capable of reducing the temperature of the refuse and oil in path 22 to a level near or below the boiling point of isobutane which is around 11° C. at atmospheric pressure. Mixing may, of course, take place at pressures higher than atmospheric, in which case, the cooling requirements are somewhat reduced.

Various higher boiling gases such as n-butane, and pentanes, or mixtures thereof can be used. Gases such as propane, ethane and natural gas can also be used, although their boiling points are so low that their liquefaction may not be economically practical in many installations.

Likewise, higher-boiling hydrocarbons such as hexane and heptane can be used. However, higher-boiling hydrocarbons require the application of more heat to effect evaporation, and the use of hydrocarbons having very high boiling points tends to become less advantageous or even impractical from an economic standpoint.

The mixture of liquefied gas and cooled refuse and oil is delivered from mixer 26 through valve 38 to separator 40. Separator 40 can be, for example, a decanting device, a thickener, a sieve, a screen separator, a basket centrifuge, or any mechanical separating device suitable for effecting at least partial separation of liquid and solid component of a mixture. In mixer 26, the liquefied gas acts as a solvent for the oil, and washes a major portion of the oil from the refuse. Separator 40 mechanically separates dissolved oil and liquefied gas from solid refuse, and delivers the mixture of oil and liquefied gas through valve 42 to an evaporator 44. Heat is applied to evaporator 44 from an external source, and some heat can be derived from cooler 36 of the liquefaction apparatus as indicated by heat path 46. Evaporator 44 effects substantially complete separation of the oil and the liquefied gas by evaporation. The gas is returned to the gas supply through path 48, and the oil is returned to Foulke process path 6 through path 50. The oil in path 50, however, need not be returned to the Foulke process, and can be used wherever desired. For example, the oil in path 50 can be added directly to the coal-oil mixture in path 8. Likewise, the gas in path 48 need not be returned to the gas supply line.

Refuse is delivered from separator 40 through path 52. This refuse may still contain some solvent, and may also contain considerable quantities of oil because of incomplete washing in mixer 26. A second washing is carried out using mixer 54 and separator 56 which are similar respectively to mixer 26 and separator 40. Refuse in path 52 is delivered to mixer 54 through valve 58, and an additional quantity of liquefied gas from path 28 is delivered to mixer 54 through valve 60. Further solution of residual oil in the liquefied gas takes place within mixer 54, and the mixture is delivered to separator 56 through valve 62. Separator 56 delivers a mixture of oil and liquefied gas through valve 64 and path 66 to evaporator 44, and delivers substantially oil-free refuse to path 68.

While the apparatus shown uses two washing stages, any desired number of washing stages can be used, depending upon the amount of oil desired to be removed from the refuse. The refuse in path 68 contains relatively little oil, but carries with it a considerable quantity of liquefied gas. The refuse and liquefied gas in path 68 are delivered through valve 70 to a screening device 72. This screening device can be a simple screen, or, can be any mechanical separating device such as a basket centrifuge. Device 72 serves to effect substantially complete separation of liquefied gas from the refuse. The liquefied gas separated out by device 72 is delivered through path 74 to a heat exchanger 76, which effects evaporation, and delivers gas to path 78, through which gas can be returned to the gas supply line, or otherwise used. The solid refuse is delivered through path 80 to a dryer 82, which evaporates any residual liquefied gas, and delivers it to heat exchanger 76. Refuse, discarded through path 84, is substantially dry and oil-free. Small quantities of oil and solvent may, of course, be present as a result of an affinity of the refuse for these substances. Heat exchanger 76 and dryer 82 are supplied with heat from an external source of heat. At least a portion of the heat used for the operation of the dryer and heat exchanger 76 can be derived from cooler 24 through heat path 86.

It will be apparent that the heat produced by coolers 24 and 36 can be used wherever required in the system. For example, the heat from cooler 36 can be used to operate dryer 82 or heat exchanger 76, and the heat from cooler 24 can be used to operate evaporator 44.

To summarize the operation of the apparatus just described, what is essentially involved is the washing of oil-carrying refuse with a volatile solvent, preferably a liquefied hydrocarbon having a boiling point not far from ambient temperatures. After washing the oil-carrying refuse with the volatile solvent, the mixture is separated by mechanical means into two components. The first component is primarily a mixture of oil and solvent. The second component is primarily a mixture of refuse and solvent. In each case, the volatility of the solvent allows recovery of solvent by evaporation. Accordingly, the process permits the recovery of most of the oil in usable form from the refuse of a coal cleaning process, and the delivery of a substantially oil-free refuse which can be discarded. The process permits recovery of most of the volatile solvent so that is can be reused.

The particular form which the apparatus takes depends on the particular characteristics of the volatile solvent which is used in the process. Liquefaction apparatus 30 will normally include a compressor as well as a cooler for the liquefaction of low-boiling solvents such as isobutane, propane, ethyl chloride and the like. Where these low-boiling solvents are used, it is important to bring the refuse to a relatively cool condition before contacting the refuse with the solvent, and cooler 24 is used for this purpose, particularly where heat is used in the Foulke process for reduction of viscosity of the cleaning medium. With low-boiling solvents, evaporation in evaporator 44 can be effected by the mere application of ambient heat, or the application of heat from heat path 46.

On the other hand, higher boiling solvents such as n-butane, pentanes, etc. can be easily condensed without compression, and therefore compressor 34 can be eliminated from the liquefaction apparatus so that the liquefaction apparatus is in the nature of a condenser. With higher boiling solvents, cooler 24 is less important, though it may still be desirable where the refuse and oil in path 22 are hot as a result of heat used in the Foulke process for viscosity reduction. For higher boiling solvents, evaporator 44 will normally require an external source of heat in addition to the heat supplied from cooler 36 through heat path 46.

While specific hydrocarbons have been mentioned for use as the solvent in this process, it will be apparent to those skilled in the art that a very wide variety of volatile solvents may be used. Examples of volatile solvents which can be used in the process include, but are not limited to: the paraffins already referred to such as propane, butanes and pentanes; halogenated hydrocarbons such as carbon tetrachloride, chloroform, ethyl chloride, ethylene dichloride, methylene chloride, perchloroethylene and trichloroethylene; and aromatic hydrocarbons such as benzene, toluene and xylene. Various solvent mixtures, of course, can be used. In fact, ordinary gasoline may be used.

Depending on the particular solvent used, care must be taken to avoid the escape of toxic vapors particularly in the evaporation steps. Also care must be taken not to exceed the flash point of the solvent in the evaporation steps.

While the process described above relates specifically to the treatment of oil-carrying refuse produced by the Foulke process, a related process can be used for the recovery of oil from the coal-oil mixture produced in the course of cleaning coal using oil as a cleaning medium.

In certain cases, the oil which is used as a cleaning medium may be quite expensive, and therefore it may be desirable to recover the oil for various purposes such as reuse in the cleaning process, instead of burning it as part of a coal-oil fuel.

The coal-oil mixture produced in the cleaning process may be treated by first mechanically separating as much oil from the coal-oil mixture as is economically feasible, leaving an intermediate product comprising coal particles carrying oil. Mechanical separation can be carried out by any of the various mechanical separating means referred to previously. The intermediate product is then treated with a volatile solvent in the same manner in which the refuse is treated in the foregoing description. Specifically, the intermediate product, comprising coal particles carrying oil, is admixed with a volatile solvent in a mixer. In the mixer, the solvent dissolves at least a portion of the oil. The admixture is then mechanically separated into a first component comprising a mixture of oil and solvent and a second component comprising coal particles and solvent. The admixing and separating steps cause the proportion of oil to coal particles in the second component to be less than the proportion of oil to coal particles in the intermediate product. Solvent is evaporated from one or both of the first and second components, and is recovered for reuse.

If the first component, which comprises a mixture of oil and solvent is separated into its components by evaporation, the solvent can be recovered for reuse in the treatment of the intermediate product, and the oil can also be recovered for reuse in the cleaning process. The solvent may also be evaporated from the second component, leaving substantially dry, oil-free coal particles, which can be burned as a solid fuel.

The treatment of the coal-oil mixture may be carried out using apparatus similar to that described with reference to the treatment of refuse, including apparatus for pre-cooling the intermediate product prior to admixture with the volatile solvent, and also including liquefaction apparatus for reliquefying evaporated solvent. As solvent treatment of the coal-oil mixture will normally be on a larger scale than the treatment of refuse, the recovery of heat from the pre-cooler and from the liquefaction apparatus, and the use of the heat in evaporation is even more valuable in the solvent treatment of coal-oil mixtures than it is in the solvent treatment of refuse.

I claim:

1. In a process for cleaning coal in which oil is used as a cleaning medium and in which solid refuse is produced, the refuse carrying with it a quantity of oil: the improvement comprising the steps of admixing a volatile solvent with the solid refuse; dissolving at least a portion of the refuse-carried oil in said solvent; mechanically separating the admixture into a first component comprising a mixture of oil and solvent and a second component comprising solid refuse and solvent, the proportion of oil to refuse in the second component being less than the proportion of oil to refuse in the refuse produced in the cleaning process; and evaporating solvent from at least one of said first and second components.

2. The improvement according to claim 1 in which a major portion of the refuse-carried oil is dissolved in said solvent.

3. The improvement according to claim 1 in which the admixing, dissolving and mechanical separating steps are carried out in at least two stages by a first admixing step in which refuse is admixed with solvent, a first dissolving step in which a portion of the refuse-carried oil is dissolved in the solvent used in the first admixing step, and a first separating step in which a quantity of oil and solvent is removed as part of said first component, leaving a mixture comprising solid refuse, solvent and oil; a second admixing step in which a further quantity of solvent is added to said mixture of solid refuse, solvent and oil, a second dissolving step in which a further portion of the refuse-carried oil is dissolved in solvent, and a second separation step in which a quantity of oil and solvent is removed as a further part of said first component and in which solid refuse and solvent is removed as said second component.

4. The improvement according to claim 1 in which solvent is evaporated from both of said first and second components.

5. The improvement according to claim 1 in which solvent is evaporated from said first component, and oil of said first component remaining after said evaporation step, is used as part of the cleaning medium in the coal cleaning step.

6. The improvement according to claim 1 in which solvent is evaporated from said second component, leaving substantially dry and oil-free refuse.

7. The improvement according to claim 1 in which the process for cleaning coal includes the step of deriving a mixture of coal particles in oil for use as a fuel, and in which solvent is evaporated from said first component, and the oil remaining after the evaporation of solvent from said first component is added to said mixture of coal particles in oil.

8. The improvement according to claim 1 in which the volatile solvent is a liquefied petroleum gas.

9. The improvement according to claim 1 comprising the step of cooling the refuse prior to the step of admixing a volatile solvent with the refuse.

10. The improvement according to claim 1 in which the volatile solvent is a liquefied petroleum gas, and including the steps of cooling the refuse prior to the step of admixing the volatile solvent with the refuse, and using at least a portion of the heat generated in the cooling step to evaporate solvent from at least one of said first and second components.

11. The improvement according to claim 1 in which the volatile solvent is a liquefied petroleum gas, and including the steps of liquefying gaseous hydrocarbons to produce said liquefied petroleum gas, and in which heat generated in said liquefying step is used to evaporate solvent from at least one of said first and second components.

* * * * *